United States Patent [19]

Campbell

[11] Patent Number: 5,044,529

[45] Date of Patent: Sep. 3, 1991

[54] LIQUID DISPENSING BOTTLE CAP WITH INTEGRAL VALUE AND ACTUATOR

[76] Inventor: Phillip J. Campbell, P.O. Box 51480, Raleigh, N.C. 27609

[21] Appl. No.: 386,575

[22] Filed: Jul. 29, 1989

[51] Int. Cl.[5] ..... B67D 3/00

[52] U.S. Cl. ..... 222/508; 222/511; 222/517; 222/518

[58] Field of Search ..... 222/505, 508, 509, 510, 222/511, 515, 517, 518, 498, 212, 213, 559

[56] References Cited

U.S. PATENT DOCUMENTS

| | | | |
|---|---|---|---|
| 1,982,440 | 11/1934 | Lebowitz | 222/213 X |
| 3,154,222 | 10/1964 | Heckman | 222/518 X |
| 3,241,727 | 3/1966 | Heckman | 222/518 X |
| 3,967,748 | 7/1976 | Albert | 222/508 X |
| 3,972,443 | 8/1976 | Albert | 222/518 X |
| 4,120,431 | 10/1978 | Schultz | 222/518 |
| 4,136,799 | 1/1979 | Albert | 222/518 X |
| 4,635,828 | 1/1987 | Kaufman | 222/212 |

*Primary Examiner*—Kevin P. Shaver
*Attorney, Agent, or Firm*—Irving M. Freedman

[57] ABSTRACT

A unitary liquid dispensing cap with integral actuator and valve assemblies is provided which includes a centrally located bellows to provide a restoring force to drive the valve back to the closed position after dispensing the liquid. A guide is provided for the valve and includes projections which cooperate with mating projections on the valve assembly to control movement of the valve. The valve assembly may be cocked to provide positive sealing of the dispensing passage by the valve.

28 Claims, 3 Drawing Sheets

LIQUID DISPENSING BOTTLE CAP WITH INTEGRAL VALUE AND ACTUATOR

The present invention relates to a dispensing bottle cap intended for use as a tap in a bottle containing a liquid to be dispensed, particularly a viscous liquid such as hair shampoo, sun tan lotion and other embrocations and liquids for application to the human body as well as sauces and salad dressings.

In such applications, it is important that the closable valve assembly retain the fluid in the bottle during transportation and handling. The bottle cap must also be reliable and yet must be manufactured in volume at a low cost to minimize the impact on the selling price of the liquid, recognizing that the dispensing bottle cap is also basically a disposable item which is disposed along with the bottle after the contents of the bottle is dispensed.

A number of different dispensing arrangements have been used or suggested in the past. However, most existing liquid dispensing caps require the use of two hands in order to dispense the liquid. For example, a protective cap must first be screwed off, or a flip top must be opened requiring one hand to hold the bottle with the other hand being used to unscrew the cap or open the flip top. Also, it is desirable to provide a dispensing bottle cap which includes an automatically closeable valve assembly which can be manually opened whenever the bottle contents is to be dispensed.

The various prior art dispensing bottle caps tend to solve some of these problems to varying degrees, but have not satisfactorily solved all of the problems.

OBJECTS AND SUMMARY OF INVENTION

Accordingly, it is an object of the present invention to provide an improved dispensing bottle cap which complies with all of the fundamental requirements discussed above.

It is another object of the present invention to provide an improved dispensing bottle cap which is simple and inexpensive to manufacture, can be operated by one hand and is positive in actuation and in reclosure.

In accordance with one form of the present invention there is provided a liquid dispensing bottle cap which includes a body and top to encircle and close the opening in a liquid container to which it is secured. An actuator including a centrally located pleated bellows is connected to a valve assembly through an actuator arm. Pressure on the actuator moves the valve assembly to open a dispensing passage in the unitary structure and compresses the bellows to provide a restoring force such that upon release of the pressure the compressed bellows drives the actuator and valve back to the closed position. A guide is provided to guide the valve into the closed position and mating projections on the guide and valve assembly control the movement of the valve. The valve assembly may be cocked to provide positive sealing of the dispensing passage by the valve through an initial compression of the bellows in the rest position.

Figure 1:
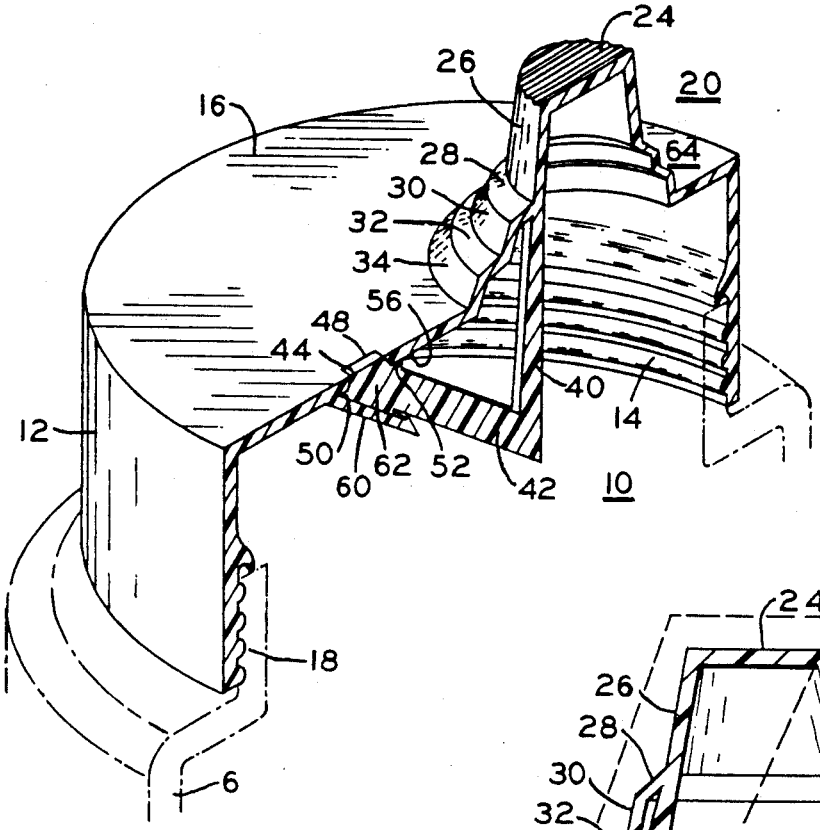
FIG. 1 is a cutaway section of a dispensing bottle cap in accordance with one embodiment of the present invention.

Referring to FIG. 1, a dispensing bottle cap 10 is shown which includes aa generally cylindrical body 12 with internal threads 14 which are adapted to cooperate with mating external threads 18 on the mouth of the bottle 6 to which it is secured. The cylindrical body 12 is connected by the substantially planar top 16 to the centrally located actuator 20. The actuator 20 includes a central axially extending portion 26 having a serrated top 24, and accordion pleats 28, 30, 32 and 34 which connect the actuator 20 to the planar top 16.

Figure 2:
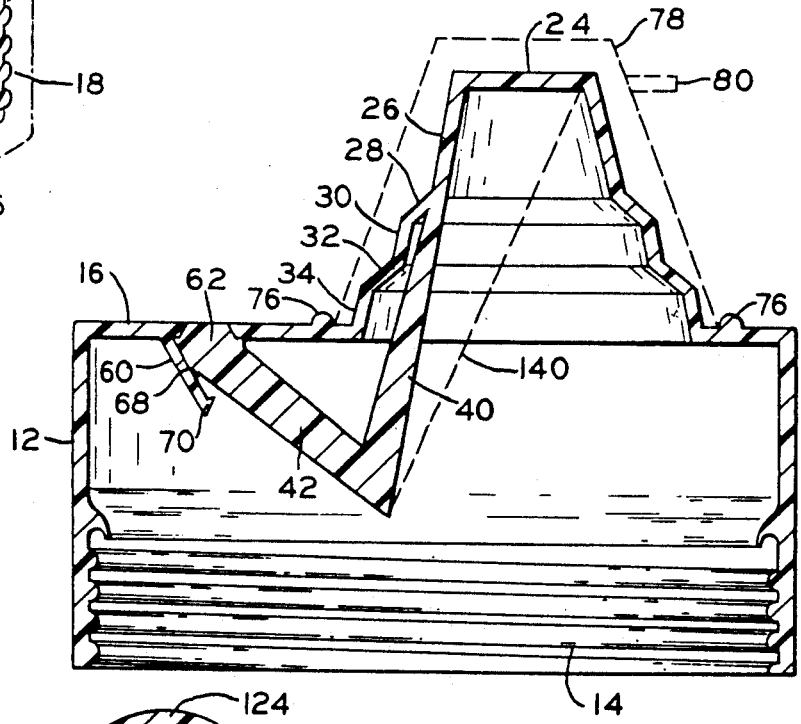
FIG. 2 is a cutaway section of a dispensing bottle cap of the type shown in FIG. 1 but including a shipping cap and a valve stop.

The actuator 20 is also connected to a depending member 40 which in turn is connected through upwardly extending arm 42 to the valve 44 on the end thereof. The valve 44 mates with, and seals the opening or dispensing passage 48 in the top 16. The opening 48 is a slot extending in a generally radial direction along the top 16, although other configurations, such as a circular opening, may be used. The valve 44 extends a distance radially which is less than the radial width of the upwardly extending arm 42 forming ledges or projections 50 and 52 which extend around the sides of the opening 48 below the planar top 16. The projections 50 and 52 assist in sealing the opening 48 and also in seating the valve 44 against the lower surface 56 of the top 16 when the upwardly extending arm 42 is urged resiliently against the top 16 in the manner described below. In addition, the valve 44 may be tapered inwardly toward the top and the dispensing passage 48 may be similarly tapered as shown in FIG. 2, facilitating the sealing of the dispensing passage when the actuator is in the at rest position.

The upwardly extending arm 42 is guided and supported by the rigid guide 60 which extends angularly down from top 16 at an angle of approximately sixty degrees and which cooperates with the end 62 of arm 42 and which extends at a mating angle. Upon movement of the arm 42, the end 62 slides along and is guided by the guide 60 to positively and firmly position the valve 44 in passage 48 to close and seal the passage.

The accordion pleats 28, 30, 32 and 34 resiliently urge the valve assembly 62 (which comprises depending member 40 upwardly extending arm 42 and valve 44) upward. To actuate the valve assembly, pressure is applied to the top 24 of the actuator assembly 64 (which comprises the serrated top 24, the axially extending portion 26 and the accordion pleats 28, 30, 32 and 34). The downward movement of the actuator assembly 64 by pressure on top 24 carries the valve assembly 62 downward with the valve assembly being guided by the guide 60 until dispensing passage 48 is uncovered, allowing fluid in the bottle 6 to pass around the valve 44 and through the dispensing passage to the exterior of the bottle.

The bottle 6 may conveniently by grasped with one hand, and the actuator assembly 64 actuated by a single finger of that hand, such as the index finger. With the bottle inverted, that is with the bottle cap 10 pointing downward, fluid will flow by gravity out through the dispensing passage 48. If the bottle 6 is fabricated of plastic, squeezing the bottle will deform the bottle and compress its volume to build up pressure within the bottle to help force the contents of the bottle out through the dispensing passage. When the pressure against the actuator assembly 64 is released, the resiliency of the compressed accordion pleats 28, 30, 32 and 34 will drive the actuator assembly 64 and valve assembly 62 upward until valve 44 again closes dispensing passage 48.

Referring to FIG. 2, the arm 42 may include a notch or projection 68, and the guide 60 may include a cooperating projection 70 so that the downward movement of the arm 42 and hence of the valve assembly 62 will be arrested to provide a stop. Thus, upon pressure to the serrated top 24, the actuator assembly 64 will be driven downward, driving the valve assembly 62 downward until the projection 68 on arm 42 is stopped by projection 70 on guide 60. The projection 70 is positioned a sufficient distance from top 16 that the valve 44 moves far enough to completely uncover dispensing passage 48 to allow the contents of the bottle 6 to be dispensed.

A safety cap is useful for shipping purposes to prevent accidental pressure on the actuator assembly 64. It may be readily included through use of a circular projection 76 which surrounds the accordion pleats 28, 30, 32 and 34 and extends upward from the planar top 16. A safety cap 78 is provided and may conveniently be a clear plastic having a tapered or frustro-conical shape.

Cap 78 is dimensioned at its bottom to fit snugly around and grip the circular projection 76 so that it snaps on the projection with pressure and is retained in place until removed. Removal may be facilitated by a projection 80 on the side of the cap 78 which may be engaged by a finger or thumb to apply pressure upward or at an upward angle to the axis of the cap in order to force the cap away from the projection.

Figure 3:
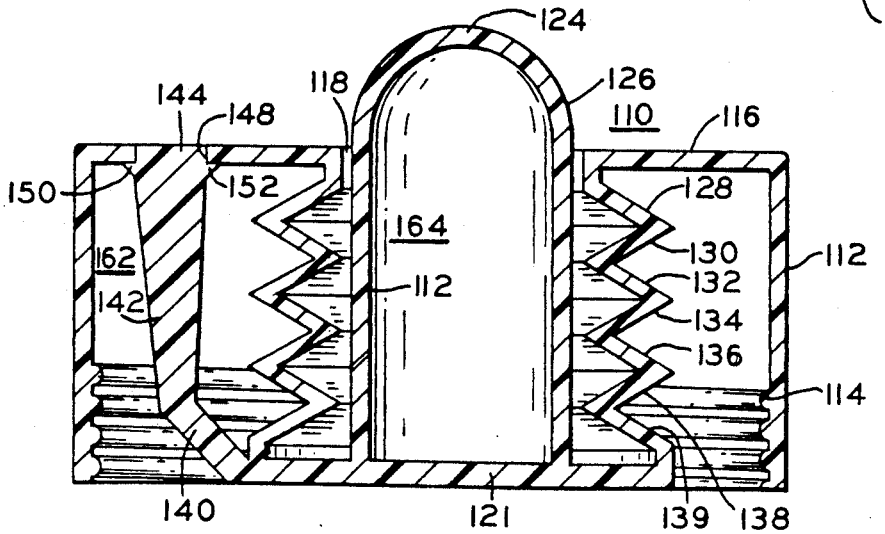
FIG. 3 is an alternative embodiment of a dispensing bottle cap in accordance with the present invention.

FIG. 3 illustrates an alternate embodiment of the present invention. Referring to FIG. 3, the dispensing bottle cap 110 includes a cylindrical body 112 having internal threads 114. The actuator assembly 164 includes an actuator having a top 124 and an axially extending portion 126 which is generally cylindrical in shape and extends through opening 118 and terminates in an actuator plate 121. Actuator plate 121 extends generally parallel to planar top 116. A pleated accordion assembly 128, 130, 132, 134, 136, 138 and 139 concentrically surrounds and is spaced from the cylindrical body 112 and is connected at its upper end to planar top 116 and at its lower end to the actuator plate 121 such that pressure on the actuator top 124 is transmitted through the accordion assembly to the actuator plate. The accordion assembly is stretched such that release of the pressure on the top 124 will result in the actuator assembly 164 resuming its shape as shown in FIG. 3 because of the resiliency of the stretched actuator assembly.

Also connected to actuator plate 121 is the valve assembly 162 which includes angular member 140 which extends upwardly at an angle away from the actuator assembly 164, and upwardly extending arm 142 which terminates in valve 144. The valve 144 is positioned to close opening or dispensing passage 148 and includes ledges or projections 150 and 152 which abut the bottom surface of planar top 116 to provide a positive sealed closure of the dispensing passageway 148 when the actuator 164 is in the position shown in FIG. 3.

When downward pressure is applied to the actuator 120 the actuator plate 121 is moved downward against the resiliency of the accordion assembly and carries the valve assembly 162 with it moving the valve 144 out of dispensing passage 148 to allow liquid within the bottle 6 to flow out the dispensing passage 148, particularly if the bottle and cap are inverted. When the pressure on the actuator 120 is removed, the stretched accordion assembly pleats 128, 130, 132, 134, 136, 138 and 139 is allowed to contract back to its original shape moving actuator plate 121 and valve 144 upward until the projections 150 and 152 contact the bottom surface of planar top 116 and valve 144 along with the projections seal the dispensing passage 148.

Accordingly, the present invention provides a unitary dispensing bottle cap which is simple and inexpensive to manufacture and which can be positively actuated by one hand to dispense liquids and to automatically reclose the dispenser upon release of the hand pressure.

Figure 4:
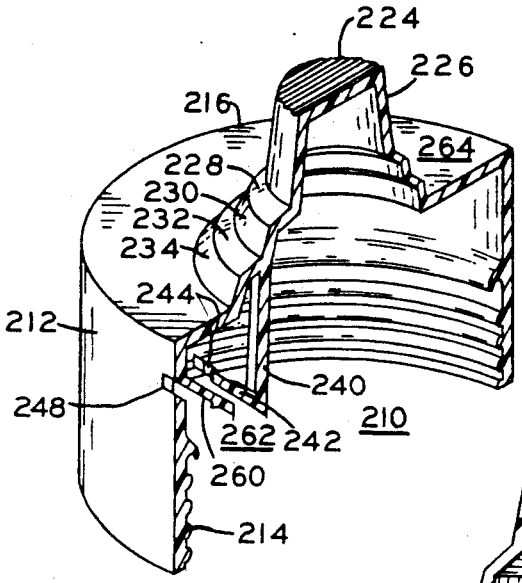
FIG. 4 is a cutaway section of an alternate embodiment of the present invention.

Referring to the embodiment shown in FIG. 4, the dispensing bottle cap 210 includes a cylindrical body 212 having internal threads 214. The actuator assembly 264 includes an actuator having a top 224 and an axially extending portion 226 which is generally cylindrical in shape. A pleated accordion assembly 228, 230, 232, and 234 connects the actuator 224 to the planar top 216. The actuator is also connected to depending member 240 which in turn is connected through the upwardly extending ar 242 to the valve 244 on the end thereof. The valve 244 mates with, and seals the opening or dispensing passage 248 in the side of cylindrical body 212 in the region of the top 216 as described below.

A rigid guide 260 extends angularly out from the cylindrical body 212 at an angle of approximately sixty degrees to cooperate with the end portion of arm 242 which extends at a mating angle. FIG. 4 shows the position of the arm 242 and valve 244 as molded, and in the "uncocked" position.

Figure 5:
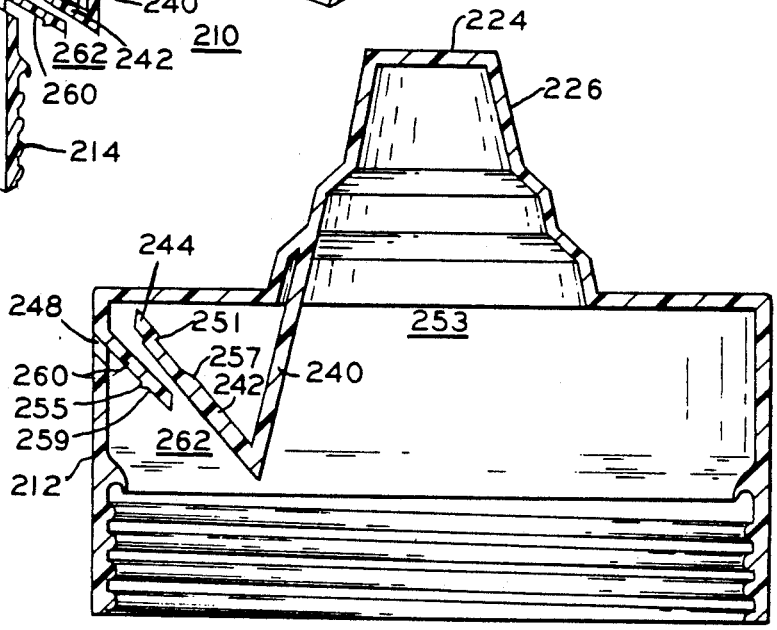
FIG. 5 is a cross section of the embodiment of the present invention shown in FIG. 4 illustrating the details of the valve assembly.
Figure 6:
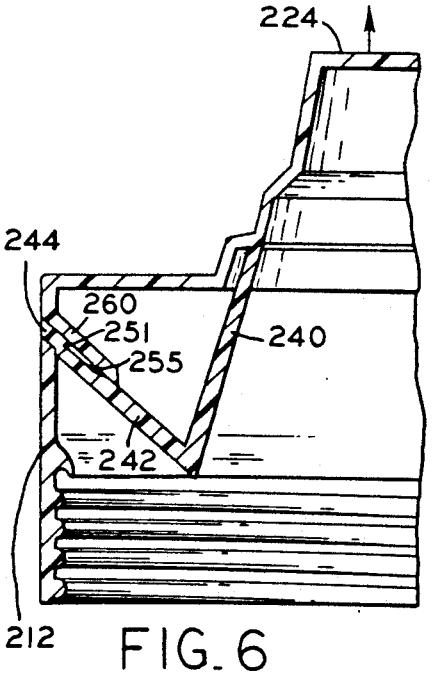
FIGS. 6 and 7 illustrate details of the cocking mechanism of the embodiment of the present invention shown in FIG. 4.
Figure 7:
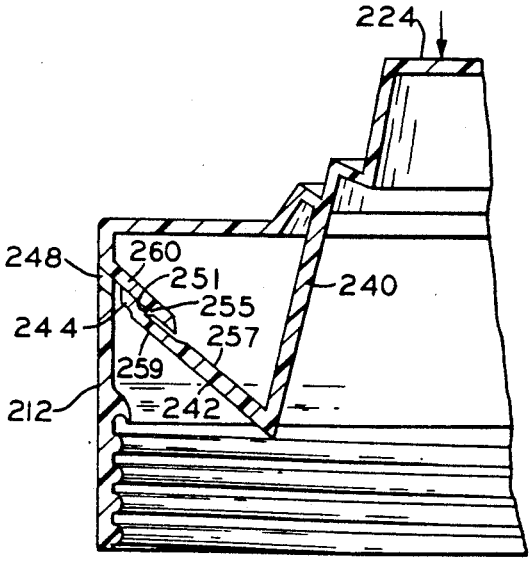

FIGS. 5, 6 and 7 shows the details of the valve assembly 262 of the embodiment illustrated in FIG. 4. Referring to FIG. 5, it is to be noted that the end of upwardly extending arm 242 includes a tapered plug valve 244, and a notch 251 on the edge closest to the depending member 40 and the interior 253 of the dispensing cap 210. The notch 251 is positioned on depending member 240 in the region of plug valve 244. The guide 260 includes a notch or projection 255 near the end thereof, and positioned on the edge of the guide opposite to, or remote from, the upwardly extending arm 242. FIGS. 4 and 5 show the dispensing cap 210 as molded.

FIGS. 6 and 7 illustrate the cocking of the valve assembly 262 in order to provide resiliency to provide a positive closure by the plug valve 244 in the opening or dispensing passage 248. Referring to FIGS. 6 and 7 in addition to FIG. 5, downward pressure on the valve assembly 264 applied to the top 224 compresses the accordion pleats 228, 230, 232, and 234 which resiliently oppose the downward pressure. The downward movement is transmitted through depending member 240 to move the arm 242 and plug valve 244 downwardly against, and guided by, rigid guide 260, bending arm 242 inwardly. When the arm 242 clears the free or lower end of the guide 260, it snaps away from the guide 270 toward the cylindrical body 212 such that is positioned generally between the guide and the cylindrical body.

Upon release of the pressure on the top 224, the compressed accordion pleats 228, 230 and 232 drive the actuator 264 upward carrying the valve assembly 262 including arm 242 upward. The upward movement of arm 242 is guided by the sliding of the interior side 257 of upwardly extending arm 242 against the side 259 of arm 242 which is closest to the body 212. The notch 251 on the arm 242 snaps or passes over the projection 255 on the guide 260 and arm 242 is driven upward until the plug valve 244 seats in, and seals, dispensing passage 248 as shown in FIG. 6. The resiliency of the accordion pleats 228, 230, and 232 provides a positive seal of the dispensing passage 248 to prevent accidental discharge of the contents of the bottle until intentional and positive pressure on the actuator 264.

When positive and deliberate pressure is applied to the actuator 264 as illustrated in FIG. 7 the accordion pleats 228, 230, 232, and 234 are compressed and the valve assembly 262 is driven downward with arm 242 sliding over the side 259 of guide 260 until the projection 251 on the arm contacts and is stopped by the projection 255 on guide 260. Meanwhile the plug valve 244 has been driven out of the dispensing passage 248 enabling dispensing of the liquid within the bottle, in the manner described above.

Removal of the positive pressure on the actuator 264 enables the compressed accordion pleats 228, 230 and 232 to drive the actuator assembly 264 upward carrying the valve assembly 262 upward until plug valve 244 seals the dispensing passage 248 in the manner shown in, and described above in connection with, FIG. 6.

Figure 8:
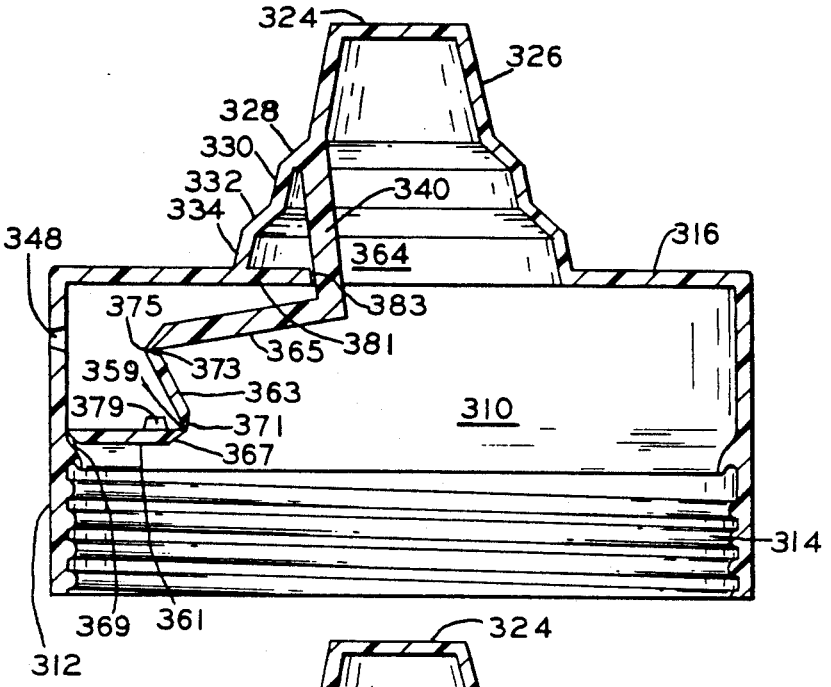
FIGS. 8, 9, and 10, are cutaway views illustrating yet another embodiment of the present invention.
Figure 9:
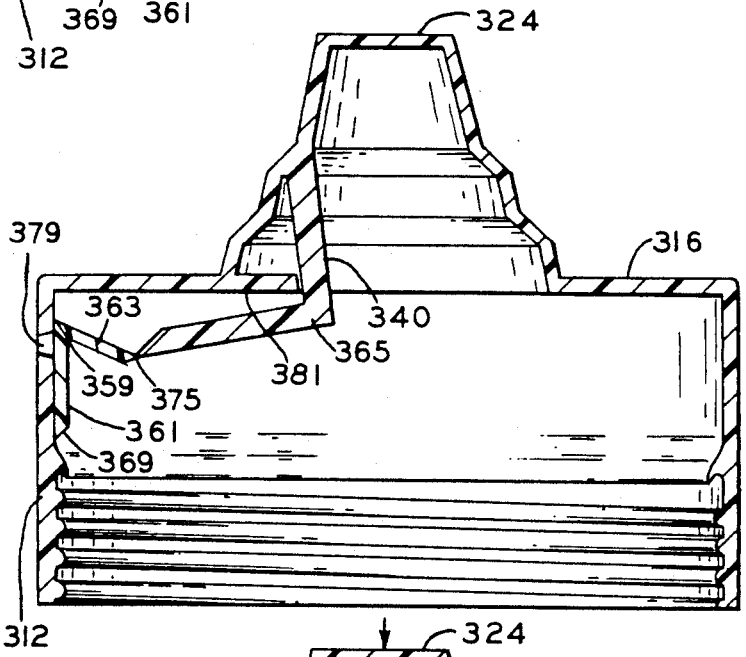
Figure 10:
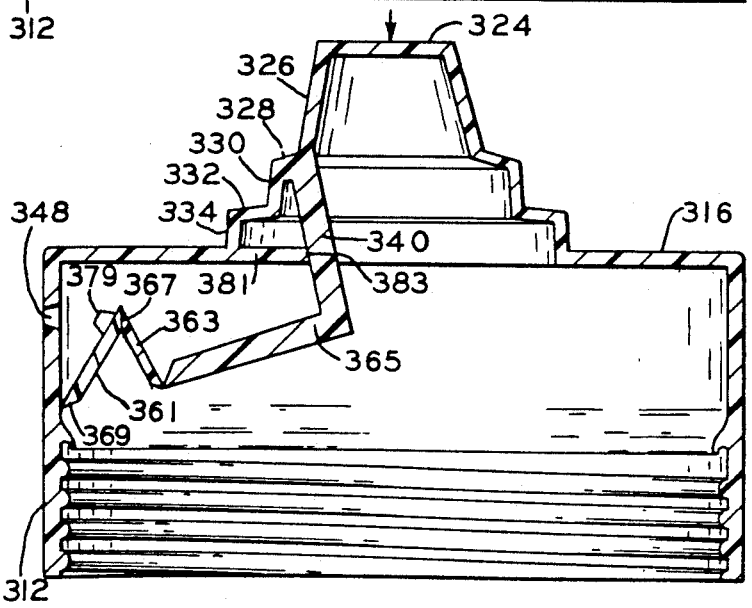

A still further embodiment of the valve assembly is shown in FIGS. 8, 9 and 10. Referring, first to FIG. 8, the dispensing bottle cap 310 includes a cylindrical body 312 having internal threads 314. The actuator assembly 364 includes an actuator having a top 324 and an axially extending portion 326 which is generally cylindrical in shape. A pleated accordion assembly 328, 330, 332, and 334 connects the actuator to the planar top 316. The actuator 364 is also connected to depending member 340 which moves downward in response to downward pressure on the actuator in the manner described above in connection with the embodiment shown, for example, in FIGS. 5, 6 and 7, and the depending member is driven upward by the compressed accordion assembly in response to the removal of the pressure on the actuator. The dispensing passage 348 is positioned in the body 312 below the planar top 316.

The cocking valve assembly includes valve 361 connected through intermediate member 363 to arm 365 which extends slightly downward from, and connects to, depending member 340. Depending member 340 and arm 365 are rigid members with the arm acting as a moveable anchor for the intermediate member 363 and the valve 361. The valve 361 is tapered on both the end 367 connecting to member 363 and the end 369 remote from that flexible connection 359. The end 371 of intermediate member 363 which is adjacent to end 367 of valve 361 is also tapered, but in a direction opposite to that of the tapered end 367. The other end 373 of intermediate member 363 which connects to arm 365 is tapered away from the flexible joint 375 therebetween. Thus, flexible joints 359 and 375 allow valve 361 and intermediate member 363 to pivot relative to one another and relative to arm 365.

FIG. 8 illustrates the position of the valve 361 and intermediate member 363 as manufactured. The dispensing cap 310 is molded of plastic suitable for use with the particular liquid being dispensed, such as, by way of example, polyvinylchloride (PVC), polyethylene or polypropolene (PP). During the manufacture of the cap 310 and after the molding process, the valve assembly including valve 361 is forced upward by pressure applied in the region of flexible connection 359 causing the valve 361 to spring against the body wall 312 in the manner shown in FIG. 9 with the intermediate member 363 pivoted upward at flexible joint 375. In that position, the dispensing passage 348 is sealed by valve 361. A tapered plug 379 may be formed on the upper surface of valve 361 as best shown in FIGS. 8 and 10 to more firmly cooperate with, and close, dispensing passage 348. In such a structure, the dispensing passage 348 is also tapered to cooperate with the tapered plug 379.

Once the dispensing cap 310 is cocked as shown in FIG. 9 with the valve 361 closing the dispensing passage 348, the cap is ready for installation on a bottle or other container and is ready for subsequent dispensing use.

The operation of the cap 310 to dispense the contents of the bottle is illustrated in FIG. 10. Referring to FIG. 10, downward pressure applied to the top 324 forces the depending member 340 downward, compressing accordion assembly 238, 330, 332, and 334 and forcing arm 365 downward, forcing intermediate member 363 downward along with the top portion of valve 361. The lower end 369 of the valve 361 pivots against wall 312 of the cap forcing the upper end 367 and plug 379 away from the dispensing passage 348, allowing fluid in the bottle 6 to pass around the valve 361 and plug 379 through the dispensing passage. Upon release of the pressure on cap 310 the compressed accordion assembly 328, 330, 332, and 334 drives the valve upward to again return to the closed position shown in FIG. 9.

A deflector or guide 381 may be provided, which as shown in FIGS. 8, 9 and 10 extends inwardly substantially parallel to the top 324 from the planar top 316 above the dispensing passage 348. The inner end 383 of the deflector 381 is tapered upwardly toward the wall 312 substantially parallel and proximate to depending member 340 to position and guide the depending member during operation of the valve 361 as shown best in FIG. 10.

While the present invention has been described as applied to a bottle, it is equally applicable to other types of containers. Also, while the liquid dispensing caps described above have been shown as molded in a unitary structure, it is possible to mold them in two or even more pieces. For example, the embodiment shown in FIGS. 1 and 2 might conveniently be molded in two parts, with the depending member 40 and the upwardly extending arm 42 including plug valve 44 molded separate from the remainder of the cap and secured in place after molding. In such a structure, the top of the depending member 40 could be widened within the central extension member 22 to provide a long connecting interface across the entire bottom of the top 24. This configuration is shown by the dotted member 140 in FIG. 2. The two parts may be cemented together, in which case a slot or groove in the bottom of the top 24 may be provided for additional support and positioning of the member 140. In addition, while the present invention has been described with respect to certain preferred embodiments thereof, it is to be understood that numerous variations in the details of construction, the arrangement and combination of parts, and the type of materials used by be made without departing from the spirit and scope of the invention.

What I claim is:

1. A unitary liquid dispensing cap for a liquid container comprising:

a body portion configured to encircle an opening in the liquid container;

a top portion closing said opening;

means to secure the dispensing cap to the bottle to position said body portion and said top portion about said opening;

an integral actuator assembly secured to and passing through said top portion and including an at rest position and an actuated position;

said actuator assembly comprising an actuator and an accordion pleated member positioned below said top portion and connecting said top portion to a valve assembly integral with said dispensing cap;

said valve assembly comprising an arm connected to a valve;

said valve being position within and closing a dispensing passage when said actuator is in the at rest position;

said actuator assembly and valve assembly being moved downward upon pressure being applied to said actuator;

said movement opening said dispensing passage and developing a restoring force in said accordion pleated member which opposes said pressure; and said restoring force moving said actuator assembly and said valve assembly upward upon release of pressure applied to said actuator;

whereby said valve recloses said dispensing passage.

2. The liquid dispensing cap of claim 1 wherein said dispensing passage passes through said top portion.

3. The liquid dispensing cap of claim 2 wherein said valve includes a ridge extending from said valve to contact the inside surface of said top portion to assist in sealing said dispensing surface and providing a stop for said at rest position.

4. The liquid dispensing cap of claim 3 wherein said accordion pleated member includes an end portion remote from said top portion, said end portion being connected to a plate member for movement therewith.

5. The liquid dispensing cap of claim 4 wherein pressure on said actuator moves said plate member away from said top portion and moves said valve away from said top member uncovering said dispensing passage.

6. The liquid dispensing cap of claim 1 wherein a guide is provided to cooperate with said arm to guide said valve into said dispensing passage.

7. The liquid dispensing cap of claim 6 wherein said arm includes a first projection positioned below said valve and said guide includes a second projection below said first projection when said actuator is in said at rest position and positioned to act as a stop for said first projection when said actuator is in the actuated position.

8. The liquid dispensing cap of claim 7 wherein said means to secure said dispensing cap to the container comprises internal threads on said body portion configured to mate with cooperating threads on said container, and said actuator arm is positioned in the region between said thirds and said actuator assembly.

9. A dispensing cap for viscous liquids adapted to be secured to a bottle having an opening, through threads on the interior of the cap cooperating with exterior threads on the bottle, and surrounding said opening and adapted to be operated by one hand comprising:

a body portion and a top portion configured to surround the opening of the bottle;

an actuator assembly secured to said top portion and having an at rest and an actuated position;

a dispensing passage in said top portion;

a valve assembly connected to said actuator assembly through an accordion pleated member and including a valve positioned in and closing said dispensing passage when said actuator is in said at rest position; and pressure on said actuator moving said valve to said actuated position to uncover said dispensing passage against the resiliency of said accordion pleated member;

such that the release of said pressure enables the resiliency of said accordion pleated member to move said valve and said actuator to the at rest position in which said valve is repositioned in and recloses said dispensing passage;

wherein said dispensing passage passes through said top portion; and said accordion pleated member is positioned below said top portion and extends into said bottle.

10. The liquid dispensing cap of claim 9 wherein an actuator plate is connected to said accordion pleated member, said valve assembly, and said actuator for their simultaneous movement upon pressure being applied to said actuator.

11. A dispensing cap for viscous liquids adapted to be secured to a bottle having an opening, through threads on the interior of the cap cooperating with exterior threads on the bottle, and surrounding said opening and adapted to be operated by one hand comprising:

a body portion and a top portion configured to surround the opening of the bottle;

an actuator assembly secured to said top portion and having an at rest and an actuated position;

a dispensing passage in said top portion;

a valve assembly connected to said actuator assembly through an accordion pleated member and including a valve positioned in and closing said dispensing passage when said actuator is in said at rest position; and pressure on said actuator moving said valve to said actuated position to uncover said dispensing passage against the resiliency of said accordion pleated member;

such that the release of said pressure enables the resiliency of said accordion pleated member to move said valve and said actuator to the at rest position in which said valve is repositioned in and recloses said dispensing passage; and wherein a guide extends inwardly from said body portion in the region of said dispensing passage to control the movement of said valve assembly during the movement of said actuator assembly to the actuated position.

12. The liquid dispensing cap of claim 11 wherein said dispensing passage passes through said top portion.

13. The liquid dispensing cap of claim 11 wherein said top portion includes an annular ridge surrounding said actuator assembly and a cover configured to be secured to said annular ridge to surround the portion of said actuator assembly above said top portion to prevent accidental actuation of said actuator assembly.

14. The liquid dispensing cap of claim 13 wherein said cover comprises at least a portion of a tapered conical surface.

15. The liquid dispensing cap of claim 11 wherein said top portion includes a central portion positioned over the central region of said opening of said bottle and said accordion pleated member is positioned above the central portion of said top portion.

16. The liquid dispensing cap of claim 15 wherein said valve assembly comprises a depending member connected to said accordion pleated member and extending into said bottle, and an upwardly extending arm connecting said depending member to said valve.

17. The liquid dispensing cap of claim 16 wherein a projecting ledge extends from said upwardly extending arm in a direction substantially parallel to said top portion below said valve to assist in sealing said dispensing passage.

18. The liquid dispensing cap of claim 17 wherein a guide depends at an angle from said top portion and cooperates with said upwardly extending arm to guide said valve into said dispensing passage.

19. The liquid dispensing cap of claim 18 wherein mating projections on said guide and said valve assembly limit the movement of said valve assembly upon the actuation thereof to said actuated position.

20. The liquid dispensing cap of claim 11 wherein said bottle is of a size suitable for grasping by one hand of an operator and said actuator is centrally located above said top portion for actuation by a finger of said one hand of the operator.

21. The liquid dispensing cap of claim 11 wherein said valve is tapered toward the top portion thereof and said dispensing passage is similar tapered to cooperate with said valve in sealing said dispensing passage when said actuator is in said at rest position.

22. The liquid dispensing cap of claim 11 wherein said valve assembly includes a cocking mechanism having an uncocked position and a cocked position in which said valve assembly closes said dispensing passage.

23. The liquid dispensing cap of claim 22 wherein said cap is a unitary molded assembly and said uncocked position of said valve assembly is the as molded configuration, and said valve assembly includes an upwardly extending arm which in the uncocked position is positioned generally alongside said guide with said guide positioned between said arm and said dispensing passage and the cocking of said valve mechanism being accomplished by the movement of said actuator assembly which compresses said accordion pleated member, and said upwardly extending arm is positioned on the other side of said guide between said guide and said dispensing passage such that said compressed accordion pleated member presses said valve assembly against and closes said dispensing passage.

24. The liquid dispensing cap of claim 23 wherein said guide and said upwardly extending arm each include mating projections to limit the movement of said arm and said valve assembly in a first position closing said dispensing passage and a second position opening said dispensing passage.

25. The liquid dispensing cap of claim 22 wherein said valve assembly includes an arm extending in a direction toward said dispensing passage, and an intermediate member flexibly mounted to said arm at one end and flexibly mounted to said valve on the other end, said valve having an uncocked position and cocked position and being moveable from said uncocked position to said cocked position by pressure on said bellows assembly which moves said valve to the proximity of said dispensing passage and compresses said bellows assembly, such that release of said pressure allows the compressed bellows assembly to drive said valve in the reverse direction to close said dispensing passage.

26. The liquid dispensing cap of claim 25 wherein said compressed bellows maintains pressure on said valve to positively close said dispensing passage in the absence of pressure applied to said actuator.

27. The liquid dispensing cap of claim 26 wherein said valve includes a plug extending out from the surface of said valve configured to substantially fill and close said dispensing passage with the surface of said valve surrounding and sealing the inner end of said dispensing passage.

28. The liquid dispensing cap of claim 27 wherein said cap is a unitary molded cap and said flexibly mounted intermediate member includes narrowed plastic connections.

* * * * *